US009574564B2

(12) United States Patent
Ingles et al.

(10) Patent No.: US 9,574,564 B2
(45) Date of Patent: Feb. 21, 2017

(54) METHODS AND SYSTEMS FOR MAINTAINING A HIGH VACUUM IN A VACUUM ENCLOSURE

(75) Inventors: Martin Richard Ingles, Coventry (GB); Ruben Fair, Niskayuna, NY (US); Joseph Eugene, Warwickshire (GB)

(73) Assignee: GE Energy Power Conversion Technology LTD. (GB)

( * ) Notice: Subject to any disclaimer, the term of this patent is extended or adjusted under 35 U.S.C. 154(b) by 823 days.

(21) Appl. No.: 13/990,239

(22) PCT Filed: Nov. 24, 2011

(86) PCT No.: PCT/EP2011/070900

§ 371 (c)(1),
(2), (4) Date: Jul. 11, 2013

(87) PCT Pub. No.: WO2012/072478

PCT Pub. Date: Jun. 7, 2012

(65) Prior Publication Data

US 2014/0294605 A1 Oct. 2, 2014

(30) Foreign Application Priority Data

Nov. 30, 2010 (EP) ..... 10015125

(51) Int. Cl.
*F04D 13/12* (2006.01)
*F04C 23/00* (2006.01)
(Continued)

(52) U.S. Cl.
CPC ..... *F04D 13/12* (2013.01); *F04B 37/14* (2013.01); *F04C 23/006* (2013.01); *F04C 25/02* (2013.01); *F04D 25/16* (2013.01)

(58) Field of Classification Search
CPC .... F04D 15/0005; F04D 19/04; F04D 19/042; F04D 19/046
(Continued)

(56) References Cited

U.S. PATENT DOCUMENTS 4,770,609 A * 9/1988 Uchida ..... F04C 18/16 417/2
5,039,280 A 8/1991 Saulgeot et al.
(Continued)

FOREIGN PATENT DOCUMENTS

CN 1707102 A 12/2005
DE 868330 C 2/1953
(Continued)

OTHER PUBLICATIONS

Unofficial English Translation of Japanese Office Action issued in connection with corresponding JP Application No. 2013-541297 on Sep. 8, 2015.
(Continued)

*Primary Examiner* — Patrick Hamo
(74) *Attorney, Agent, or Firm* — Wood IP LLC

(57) ABSTRACT

A system for maintaining a high vacuum in a vacuum enclosure such as cryostat, for example, is described. The system includes a high-vacuum pump having an input that is connected to the cryostat and an output. A vacuum vessel is connected to the output of the high-vacuum pump. A second vacuum pump is connectable to the vacuum vessel. The system is operated such that the high-vacuum pump maintains the cryostat at a high vacuum and the second vacuum pump is periodically operated to maintain the pressure of the vacuum vessel below a threshold pressure. The second vacuum pump may be either permanently connected to, or removable from, the vacuum vessel. The vacuum vessel acts to maintain the output of the high-vacuum pump within a
(Continued)

suitable pressure range. This removes the need for the output of the high-vacuum pump to be connected to a continuously operating, second-stage vacuum pump. Furthermore, the second vacuum pump is only required to be operated periodically in order to maintain the pressure in the vacuum vessel below the threshold pressure.

18 Claims, 2 Drawing Sheets

(51) Int. Cl.
*F04C 25/02* (2006.01)
*F04B 37/14* (2006.01)
*F04D 25/16* (2006.01)

(58) Field of Classification Search
USPC ..... 417/201, 205; 415/90
See application file for complete search history.

(56) References Cited

U.S. PATENT DOCUMENTS

| | | | | |
|---|---|---|---|---|
| 5,236,562 | A | 8/1993 | Okumura et al. | |
| 6,257,835 | B1 | 7/2001 | Kaehler | |
| 6,597,082 | B1 * | 7/2003 | Howard | H02K 3/47 310/201 |
| 7,189,066 | B2 | 3/2007 | Liepert | |
| 7,793,685 | B2 * | 9/2010 | Desbiolles | F04D 19/04 137/565.23 |

FOREIGN PATENT DOCUMENTS

| | | | |
|---|---|---|---|
| DE | 1023854 | B | 2/1958 |
| DE | 1226239 | B | 10/1966 |
| DE | 4232119 | A1 | 3/1994 |
| DE | 20 2009 003980 | U1 | 8/2010 |
| EP | 0692635 | A2 | 1/1996 |
| WO | 2005031287 | A2 | 4/2005 |

OTHER PUBLICATIONS

Unofficial English translation of Office Action issued in connection with corresponding CN Application No. 201180065162.8 on Mar. 24, 2015.

* cited by examiner

METHODS AND SYSTEMS FOR MAINTAINING A HIGH VACUUM IN A VACUUM ENCLOSURE

FIELD OF INVENTION

The present invention provides a method and a system (or apparatus) for maintaining a high vacuum in a vacuum enclosure such as a cryostat, for example, using a high-vacuum pump, a vacuum vessel and a second vacuum pump.

BACKGROUND OF THE INVENTION

For many applications it is necessary to create and maintain a high vacuum within a vacuum enclosure. For example, in order to maintain components within a cryogenic temperature range it is often necessary to enclose the cryogenically cooled components within a vacuum enclosure in order to minimise the heating of the components. As a result, there is a need for systems and methods for maintaining high vacuums.

As will be readily understood, a high vacuum is any vacuum where the mean free path of residual gases is longer than the size of the vacuum enclosure containing the gases. Generally, a high vacuum is defined as a vacuum having a pressure of about 100 mPa or lower.

In order to create a high vacuum multi-stage pumping is required. Typically, this is achieved by using a combination of a high-vacuum pump and a second-stage vacuum pump. The high-vacuum pump may be a turbo-molecular pump or other similar pump and has an input that is connectable to a vacuum enclosure and an outlet. The outlet of the high-vacuum pump is connected to an input of the second-stage vacuum pump. The second-stage vacuum pump has an outlet that is vented to the surrounding environment. In order to maintain a high vacuum it is necessary for both the high-vacuum pump and the second-stage pump to be continuously operating.

In a typical two-stage pumping system, the inlet of the high-vacuum pump and the vacuum enclosure are maintained at a high vacuum. The high-vacuum pump then acts to compress gas entering the pump such that the pressure of the outlet of the high-vacuum pump is at a higher pressure than the pressure of the inlet and the vacuum enclosure. The outlet of the high-vacuum pump is connected to the inlet of the second-stage vacuum pump. The second-stage vacuum pump is operated to compress gas entering from the high-vacuum pump and has an output that is at a higher pressure than its input. The primary purpose of the second-stage vacuum pump is to ensure that the outlet of the high-vacuum pump is at a low or medium vacuum. This is necessary as many high-vacuum pumps will stall if they are exhausted to atmospheric pressure.

Requiring the continuous operation of two separate vacuum pumps in order to maintain a vacuum can be a problem for some applications. This is because regular maintenance of the vacuum pumps is necessary to keep them in good working order. This can be a particular problem for applications where the vacuum enclosure is located in an inaccessible location. Furthermore, the use of two vacuum pumps can be a problem if the vacuum enclosure is not stationary during operation. One application where there are particular problems is rotary cryostats for superconducting wind turbines. These cryostats rotate during operation and are located in a very inaccessible location, in a nacelle at the top of a wind turbine tower.

Currently it is not possible to use conventional two-stage pumping systems to provide a high vacuum for rotary cryostats for superconducting wind turbines. One reason for this is the very poor conductance down the rotor shaft of such turbines. However, there are also other technical considerations that make the use of conventional, continuously-operating, two-stage pumping systems generally unsuitable. Therefore, current proposals for providing a high vacuum for rotary cryostats for superconducting wind turbines is to use a plurality of getters located in a pre-evacuated high vacuum enclosure. Getters can act to maintain a high vacuum over a limited time period but require re-activation at regular intervals. Re-activating getters in a high vacuum can necessitate re-pressurising the vacuum enclosure in order to access the getters and then, after the getters have been re-activated, pumping the vacuum enclosure to a high vacuum using an external vacuum pump set. Alternatively, non-evaporable getters do not require the vacuum enclosure to re-pressurise but instead require a pumping system to be connected to the vacuum enclosure in order to maintain the vacuum in the vacuum enclosure whilst the getters are re-activated.

In light of the above, there is a need for an improved system and method for providing a high vacuum for vacuum enclosures that are in inaccessible locations and/or are not stationary during operation. Preferably, any such system and/or method should be capable of being used to provide a high vacuum for a rotary cryostat for a superconducting wind turbine or other electrical machine.

SUMMARY OF THE INVENTION

The present invention provides a system for maintaining a high vacuum in a vacuum enclosure comprising: a vacuum enclosure; a vacuum vessel; a high-vacuum pump having an input connected to the vacuum enclosure and an output connected to the vacuum vessel; and a second vacuum pump connectable to the vacuum vessel; wherein the high-vacuum pump is operated to maintain the vacuum enclosure at a high vacuum and the vacuum vessel is maintained below a threshold pressure by periodic operation of the second vacuum pump.

The system of the present invention is advantageous over the prior art as it omits the second-stage pump of a conventional two-stage pumping system. By connecting the output of the high-vacuum pump to a vacuum vessel which is maintained below a threshold pressure it is possible to operate the high-vacuum pump without the need for the constant operation of a second vacuum pump. The threshold pressure of the vacuum vessel is preferably the maximum pressure the output of the high-vacuum pump can be subjected to without adversely affecting the operation of the high-vacuum pump. In particular, the output of the high-vacuum pump will preferably be maintained at a pressure that prevents the high-vacuum pump from stalling.

As will be readily appreciated, the operation of the high-vacuum pump will gradually increase the pressure of the vacuum vessel due to the output of the high-vacuum pump discharging into the vacuum vessel. However, once a high vacuum has been established in the sealed vacuum enclosure, the rate of increase will be relatively low and, as a result, only periodic evacuation of the vacuum vessel using the second vacuum pump is necessary. As there is no need for a continuously operating second-stage vacuum pump, the technical complexity and required maintenance of the pumping system are greatly reduced compared to prior art systems.

Periodic operation of the second vacuum pump is required to maintain the pressure of the vacuum vessel below the threshold pressure. As will be understood by the skilled person, the length of time for which the system of the present invention will be able to operate before re-evacuation of the vacuum vessel is necessary will depend upon the volume of the vacuum vessel and the pressure of the vacuum vessel when the system is first operated. This can be easily determined for any specific system according to the present invention. The second vacuum pump may be periodically operated according to when the pressure within the vacuum vessel exceeds a pre-defined limit. Alternatively, the second vacuum pump could be operated at pre-defined time intervals. All that is required is that the periodic operation of the second vacuum pump maintains the pressure in the vacuum vessel below the threshold pressure.

The second vacuum pump may be permanently connected to the vacuum vessel or may be removable from the vacuum vessel. If the second vacuum pump is removable from the vacuum vessel then it may be preferable that it is connected to the vacuum vessel only when it is necessary to operate the second vacuum pump to maintain the pressure of the vacuum vessel below the threshold pressure. If the second vacuum pump is removable from the vacuum vessel it may be connected to the vacuum vessel by any suitable means that is apparent to the person skilled in the art.

The system of the present invention may further comprise a controller for operating the second vacuum pump when required.

It is preferable that the second vacuum pump is a low-vacuum pump. As will be apparent to the person skilled in the art, the low-vacuum pump may comprise any low-vacuum pump suitable for use in a conventional system for maintaining an appropriate vacuum. However, it may be preferable that the low-vacuum pump is a diaphragm pump.

In order to allow the periodic pumping of the vacuum vessel it is advantageous that a system according to the present invention comprises valve means at the connection between the vacuum vessel and the second vacuum pump. In order to maintain a suitable pressure in the vacuum vessel, the valve means may be closed when the second vacuum pump is not operably connected to the vacuum vessel and/or is not being operated. The valve means being opened only when the second vacuum pump is connected to the vacuum vessel and is being operated to maintain the pressure in the vacuum vessel below the threshold pressure. The valve means may comprise any suitable valve means known to the person skilled in the art. The system of the present invention may comprise a controller for controlling the valve means. A controller for a valve means may be a separate control means or it may be integrated with any controller for operating the second vacuum pump.

The high-vacuum pump may comprise any high-vacuum pump that is suitable for use in a conventional system for maintaining a high vacuum. However, it may be preferable that the high-vacuum pump is a turbo-molecular pump, e.g. of the type that utilises rapidly spinning rotors, typically with angled blades, to impart momentum to gas molecules in the direction of the exhaust or outlet.

It may be advantageous that the input to the high-vacuum pump comprises a valve. The valve will allow the vacuum enclosure to be sealed from the high-vacuum pump if necessary. This may be advantageous if it is possible to maintain a suitable pressure within the vacuum enclosure using only periodic operation of the high-vacuum pump. Alternatively or additionally, having a valve situated between the vacuum enclosure and the high-vacuum pump will allow maintenance of the high-vacuum pump without the need to evacuate the vacuum enclosure. The system of the present invention may comprise a controller for controlling intermittent operation of a high-vacuum pump. This controller may be a separate control means or may be integrated with any other control means of the system.

The vacuum enclosure may be a cryostat, for example a cryostat for a superconducting electrical machine. If the vacuum enclosure is a cryostat it may be a rotary cryostat.

If the vacuum enclosure is a rotary cryostat it may preferable that the high-vacuum pump and the vacuum vessel and any other components of the system are mounted to rotate with the rotary cryostat (i.e. in a rotating reference frame). Having these components rotate with the rotary cryostat means there is no need for a rotary coupling between stationary and rotary components.

If the components of the system are mounted to rotate with a rotary cryostat it may be preferable that the high-vacuum pump (and optionally the second vacuum pump) are mounted on the rotary cryostat such that the rotary axis of the cryostat is coaxial with the rotary axis of the high-vacuum pump (and the rotary axis of the second vacuum pump). This may be preferable because mounting the vacuum pump(s) in this manner may minimise any adverse gyroscopic effects on the vacuum pump(s) during operation of the system.

If the system of the present invention is used with, or comprises a rotary cryostat, it may be possible to mount the second vacuum pump such that the operation of the second vacuum pump is powered by the rotation of the rotary cryostat. This can be achieved in any manner apparent to a person skilled in the art.

It is anticipated that the use of a system according to the present invention to maintain a high vacuum in a rotary cryostat of a superconducting wind turbine (or other electrical machine) would be significantly advantageous compared to the use of getters to maintain a high vacuum in the same apparatus. In particular, getters are required to be re-activated at regular intervals (for example every six months) whereas it is estimated that a system according to the present invention could be used for significantly longer periods before requiring maintenance. Even then it is anticipated that the component most likely to require maintenance would be the second vacuum pump and, as a result, there would be no need to pressurise the cryostat in order to carry out the maintenance.

As set out above, previous systems for maintaining a high vacuum could not be used with rotary cryostats. The system of the present invention may be used with rotary cryostats and may be mounted to rotate with a rotary cryostat. The system of the present invention comprises a vacuum vessel. However, it is also possible to mount a system according to the prior art (i.e. a conventional two-stage pumping system for maintaining a high vacuum that does not additionally comprise an intermediate vacuum vessel) to rotate with a rotary cryostat. This can be done in any manner apparent to a person skilled in the art.

If a conventional system for maintaining a high vacuum is mounted to rotate with a rotary cryostat it may be preferable that one or both of the pumps is powered by the rotation of the rotary cryostat. This may be achieved in any manner apparent to a person skilled in the art. It is anticipated that the second-stage pump of a conventional system may be powered by the rotation of a cryostat using simple mechanical means.

The present invention also provides a method of maintaining a high vacuum in a vacuum enclosure, the vacuum enclosure being connected to an input of a high-vacuum pump and an output of the high-vacuum pump being connected to a vacuum vessel, the method comprising the steps of: operating the high-vacuum pump to maintain a high vacuum in the vacuum enclosure; and maintaining the pressure in the vacuum vessel below a threshold pressure by periodically operating a second vacuum pump to evacuate the vacuum vessel.

In the same manner as the system of the present invention, the method of the present invention is advantageous over the prior art as it does not require the continuous operation of a second vacuum pump in order to maintain a high vacuum in the vacuum enclosure. Instead, by using an intermediate vacuum vessel between the output of the high-vacuum pump and an input of the second vacuum pump, and maintaining the pressure of the vacuum vessel below a threshold pressure, the second vacuum pump is only required to operate periodically.

In order to operate the method of the present invention, the second vacuum pump may either be permanently connected to the vacuum vessel or it may be removable from the vacuum vessel. If the second vacuum pump is removable from the vacuum vessel the method of the present invention may further comprise the steps of connecting the second vacuum pump to the vacuum vessel before it is operated and disconnecting the second vacuum pump from the vacuum vessel after each operation. This can be particularly beneficial if the vacuum enclosure is not kept stationary during operation. This is because the second vacuum pump can be removed from the vacuum enclosure for relatively long periods and during these periods the vacuum enclosure can be operated in a manner that may not be possible if the second vacuum pump were to remain physically connected to the vacuum enclosure. For example, it may make it possible to rotate a vacuum enclosure at high speeds. In these situations the rotation of the vacuum enclosure could be halted when it is necessary to connect the second vacuum pump thereto.

The optional features of the system described above may be utilised in the method of the present invention. In particular, the second vacuum pump may be a low-vacuum pump, the high-vacuum pump may be a turbo-molecular pump, and the vacuum enclosure may be a cryostat. If the vacuum enclosure is a cryostat it may be rotary cryostat and any or all of the vacuum enclosure, high-vacuum pump and second vacuum pump may be mounted to rotate with the rotary cryostat, possibly by mounting any or each component coaxially with the rotary cryostat.

A specific embodiment of a system according to the present invention is described below and is shown in the drawing. The system operates according to the method of the present invention.

BRIEF DESCRIPTION OF THE DRAWINGS

Exemplary embodiments of the invention will now be described with reference to the accompanying drawings, in which.

DETAILED DESCRIPTION OF THE PREFERRED EMBODIMENTS

Figure 1:
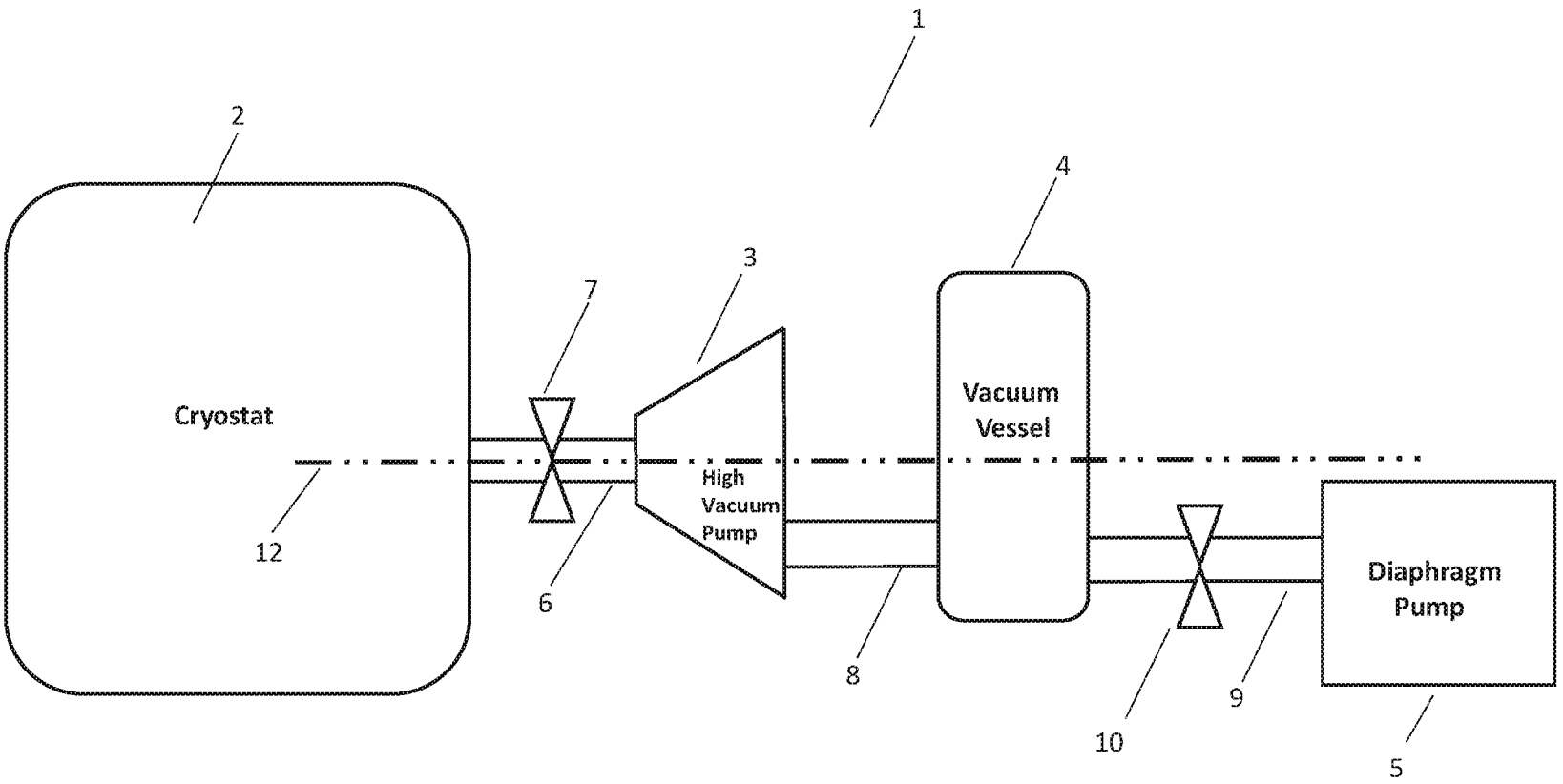
FIG. 1 is a schematic drawing of an embodiment of a system according to the present invention that operates according to the method of the present invention.

A system for maintaining a high vacuum according to the present invention is shown in FIG. 1. The system 1 comprises a stationary cryostat 2, a turbo-molecular pump 3 (or high-vacuum pump), a vacuum vessel 4 and a diaphragm pump 5 (or second vacuum pump). The turbo-molecular pump 3 has an inlet 6 that is connected to the cryostat 2. The inlet 6 of the turbo-molecular pump 3 includes a valve 7 that allows the inlet to be opened and sealed as required. The turbo-molecular pump 3 has an outlet 8 that is connected to the vacuum vessel 4. The diaphragm pump 5 has an inlet 9 that is connectable to the vacuum vessel 4 (shown to be operably connected in FIG. 1). The inlet 9 of the diaphragm pump has a valve 10 that allows the inlet to be opened and sealed as required when the diaphragm pump is connected to the vacuum vessel.

The system 1 can be operated to maintain a high vacuum in the cryostat 2 in the following manner. During normal operation, the valve 7 of the inlet 6 of the turbo-molecular pump 3 is open and the turbo-molecular pump is continuously operated to maintain the pressure within the cryostat 2 within a high vacuum range in a conventional manner. The outlet 8 of the turbo-molecular pump 3 directs the exhaust of the turbo-molecular pump to the vacuum vessel 4. During normal operation, the valve 10 is closed and the diaphragm pump 5 is not operably connected to the vacuum vessel 4. The high-vacuum pump 3 is mounted on the rotary cryostat 2 such that a rotary axis 12 of the cryostat 2 is coaxial with the rotary axis 12 of the high-vacuum pump 3.

Before initial operation, after the cryostat 2 has been evacuated to a high vacuum, the vacuum vessel 4 is evacuated using the diaphragm pump 5 such that it has a pressure suitable for the outlet 8 of the turbo-molecular pump 3. A suitable pressure for the vacuum vessel 4 will be a pressure that allows the turbo-molecular pump 3 to operate satisfactorily. In particular, the pressure of the vacuum vessel 4 must typically be low enough to prevent the turbo-molecular pump 3 from stalling. After evacuating the vacuum vessel 4, the valve 10 is closed and the diaphragm pump 5 is operably disconnected from the vacuum vessel 4. The turbo-molecular pump 3 is operated in a conventional manner to maintain the high vacuum within the cryostat 2.

Over time, as the turbo-molecular pump 3 is operating, the pressure of the vacuum vessel 4 will rise due to the gas entering the vacuum vessel 4 from the exhaust of the turbo-molecular pump 3. When the pressure of the vacuum vessel 4 rises to a first pre-defined limit (i.e. a threshold pressure) the diaphragm pump 5 is operably connected to the vacuum vessel 4. The valve 10 of the inlet 9 of the diaphragm pump 5 is opened and the diaphragm pump 5 is operated to re-evacuate the vacuum vessel. When the action of the diaphragm pump 5 has reduced the pressure in the vacuum vessel 4 to a second pre-defined limit, the valve 10 of the inlet 9 of the diaphragm pump 5 is closed, the diaphragm pump is stopped, and the diaphragm pump is operably disconnected from the vacuum vessel 4. In this manner the pressure within the vacuum vessel 4 can be permanently maintained between the first pre-defined limit (which is equal to, or lower than, a threshold pressure) and the second pre-defined limit. During and after the operation of the diaphragm pump 5, the turbo-molecular pump 3 is operated to maintain the high vacuum within the cryostat 2. The diaphragm pump 5 can be physically removed from the vacuum vessel 4 if necessary.

As will be readily appreciated, the precise values of the first and second pre-defined limits are dependent upon the requirements of the specific individual system. Generally, the second pre-defined limit will be the lowest pressure that can be reasonably achieved in the vacuum vessel by a diaphragm pump 5 or other conventional pumping means. The first pre-defined limit may be the upper limit of pressure at which outlet 8 of the turbo-molecular pump 3 may be maintained, i.e. the threshold pressure of the vacuum vessel.

Figure 2:
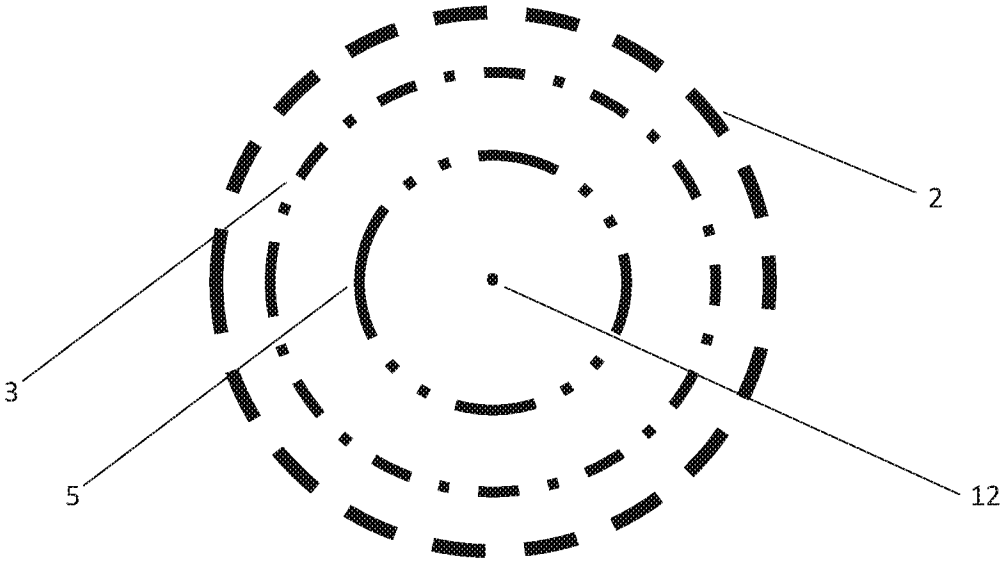
FIG. 2 is an illustration of the cryostat, high vacuum pump, and vacuum vessel, illustrated in FIG. 3, configured in accordance with a rotating reference frame, according to the embodiments. 15

In FIG. 2, the high vacuum pump 3 and the vacuum vessel 4 are mounted to rotate with the rotary cryostat 2. That is, the rotary cryostat 2 in the vacuum vessel 4 are mounted to share a rotating reference frame (i.e., rotating about the axis 12).

The cryostat can be a rotary cryostat.

What is claimed is:

1. A system for maintaining a high vacuum in a vacuum enclosure comprising:

a rotary cryostat;

a vacuum vessel;

a high-vacuum pump having an input connected to the vacuum enclosure and an output connected to the vacuum vessel; and a second vacuum pump connectable to the vacuum vessel;

wherein the high-vacuum pump is operated to maintain the cryostat at a high vacuum and the vacuum vessel is maintained below a threshold pressure by periodic operation of the second vacuum pump, and;

wherein the high-vacuum pump and the vacuum vessel are mounted to rotate with the rotary cryostat.

2. The system of claim 1, wherein the second vacuum pump is only connected to the vacuum vessel when it is necessary to operate the second vacuum pump.

3. The system of claim 1, wherein the second vacuum pump is permanently connected to the vacuum vessel.

4. The system of claim 1, wherein the second vacuum pump is a low-vacuum pump.

5. The system of claim 4, wherein the second vacuum pump is a diaphragm pump.

6. The system of claim 1, further comprising a valve formed at a connection between the vacuum vessel and the second vacuum pump.

7. The system of claim 1, wherein the high-vacuum pump is a turbo-molecular pump.

8. The system of claim 1, wherein the input to the high vacuum pump comprises a valve.

9. The system of claim 1, wherein the high-vacuum pump is mounted on the rotary cryostat such that the rotary axis of the cryostat is coaxial with the rotary axis of the high-vacuum pump.

10. The system of claim 1, wherein the second vacuum pump is powered by the rotation of the rotary cryostat.

11. A method of maintaining a high vacuum in a rotary cryostat, the rotary cryostat being connected to an input of a high-vacuum pump and an output of the high-vacuum pump being connected to a vacuum vessel; the method comprising the steps of:

operating the high-vacuum pump to maintain a high vacuum in the vacuum enclosure; and maintaining the pressure in the vacuum vessel below a threshold pressure by periodically operating a second vacuum pump to evacuate the vacuum vessel, the high-vacuum pump in the vacuum vessel being mounted to rotate with the rotary cryostat.

12. The method of claim 11, wherein the step of maintaining the pressure in the vacuum vessel by operating the second vacuum pump includes connecting the second vacuum pump to the vacuum vessel before each operation and disconnecting the second vacuum pump from the vacuum vessel after each operation.

13. The method of claim 11, wherein the second vacuum pump is permanently connected to the vacuum vessel.

14. The method of claim 11, wherein the second vacuum pump is a low-vacuum pump.

15. The method of claim 14, wherein the second vacuum pump (5) is a diaphragm pump.

16. The method of claim 11, wherein the high-vacuum pump is a turbo-molecular pump.

17. The method of claim 11, wherein the high-vacuum pump is mounted on the rotary cryostat such that the rotary axis of the cryostat is coaxial with the rotary axis of the high-vacuum pump.

18. The method of claim 11, wherein the operation of the second vacuum pump is powered by the rotation of the rotary cryostat.

* * * * *